US009727929B2

(12) United States Patent
Kubota et al.

(10) Patent No.: US 9,727,929 B2
(45) Date of Patent: Aug. 8, 2017

(54) ENERGY MANAGEMENT SYSTEM, ENERGY MANAGEMENT METHOD, PROGRAM, SERVER APPARATUS, AND LOCAL SERVER

(71) Applicant: KABUSHIKI KAISHA TOSHIBA, Minato-ku (JP)

(72) Inventors: Kazuto Kubota, Kawasaki (JP); Kyosuke Katayama, Asaka (JP); Kiyotaka Matsue, Kawasaki (JP); Takahisa Wada, Yokohama (JP); Tomohiko Tanimoto, Tama (JP); Hiroshi Taira, Tokyo (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 553 days.

(21) Appl. No.: 14/031,754

(22) Filed: Sep. 19, 2013

(65) Prior Publication Data

US 2014/0142772 A1 May 22, 2014

Related U.S. Application Data

(63) Continuation of application No. PCT/JP2013/070759, filed on Jul. 31, 2013.

(30) Foreign Application Priority Data

Nov. 21, 2012 (JP) ..... 2012-255301

(51) Int. Cl.
*G06Q 50/06* (2012.01)

(52) U.S. Cl.
CPC ..... *G06Q 50/06* (2013.01)

(58) Field of Classification Search
CPC ..... G06Q 50/06
(Continued)

(56) References Cited

U.S. PATENT DOCUMENTS 4,075,699 A * 2/1978 Schneider ..... G01R 21/00 324/103 R
2008/0046387 A1* 2/2008 Gopal ..... G01D 4/004 705/412

(Continued)

FOREIGN PATENT DOCUMENTS

EP 2 056 420 A1 5/2009
JP 2006-304402 A 11/2006

(Continued)

OTHER PUBLICATIONS

International Search Report issued Oct. 15, 2013 in PCT/JP2013/070759.

(Continued)

*Primary Examiner* — Ryan Jarrett
(74) *Attorney, Agent, or Firm* — Oblon, McClelland, Maier & Neustadt, L.L.P.

(57) ABSTRACT

According to an embodiment, energy management system includes estimating module, preparing module and controller. Estimating module estimates energy demand of a home, and obtains estimated value of energy demand of home. Estimating module estimates energy generation amount and obtains estimated value of the generation amount. Preparing module prepares discharge strategy, based on the estimated energy demand and generation amount. Discharge strategy maximizes balance obtained by subtracting power purchase loss from power selling profit, by using a push-up effect. The controller controls discharge of the energy storage, based on actual values of the energy demand and the generation amount, and the discharge strategy.

6 Claims, 11 Drawing Sheets

(58) Field of Classification Search
USPC ..... 700/291
See application file for complete search history.

(56) References Cited

U.S. PATENT DOCUMENTS

| | | | | |
|---|---|---|---|---|
| 2011/0144822 | A1* | 6/2011 | Choi | H02J 3/32 700/297 |
| 2012/0086397 | A1 | 4/2012 | Obayashi et al. | |
| 2012/0232969 | A1 | 9/2012 | Fadell et al. | |

FOREIGN PATENT DOCUMENTS

| | | | | |
|---|---|---|---|---|
| JP | 2011-072166 | | | 4/2011 |
| JP | 2011-092002 | | | 5/2011 |
| JP | 2011-130618 | A | | 6/2011 |
| JP | 2011130618 | A | * | 6/2011 |
| JP | 2012-222860 | A | | 11/2012 |
| WO | WO 2011/086886 | A1 | | 7/2011 |

OTHER PUBLICATIONS

Takae Shimada, et al., "Insolation Forecasting Using Weather Forecast with Weather Change Patterns", IEEJ Transactions on Power and Energy B, vol. 127, No. 11, Nov. 1, 2007, pp. 1219-1225 with partial English translation.
Office Action issued on Jan. 26, 2016 in Japanese Patent Application No. 2012-255301 with English translation.
Communication/ Extended European Search Report dated Oct. 18, 2016 in EP Application No. 13815363.0-1804/2924838 PCT/JP2013070759, 8 pages.

* cited by examiner

| Power(W) | Efficiency |
|---|---|
| 0 | 0 |
| 200 | 0.5 |
| 500 | 0.8 |
| 1000 | 0.95 |

FIG. 3

Purchased power

| Time period | Rate (yen/kWh) |
|---|---|
| 23:00~7:00 | 9 |
| 7:00~10:00, 17:00~23:00 | 23 |
| 10:00~17:00 | 28 |

FIG. 4A

PV surplus power purchase price

| Rate (yen/kWh) |
|---|
| 34 |

FIG. 4B

ENERGY MANAGEMENT SYSTEM, ENERGY MANAGEMENT METHOD, PROGRAM, SERVER APPARATUS, AND LOCAL SERVER

CROSS-REFERENCE TO RELATED APPLICATION

This application is a Continuation Application of PCT Application No. PCT/JP2013/070759, filed Jul. 31, 2013 and based upon and claiming the benefit of priority from prior Japanese Patent Application No. 2012-255301, filed Nov. 21, 2012, the entire contents of all of which are incorporated herein by reference.

FIELD

Embodiments described herein relates generally to a technique of managing energy income and expenditure of a customer.

BACKGROUND

Nowadays, homes are increasingly equipped with energy generators, such as photovoltaic power generation (PV) systems and fuel cells (FC), or energy storage apparatuses, such as rechargeable batteries. In addition, home energy management systems (HEMS) are conspicuously spreading. HEMS is expected as a system that enables energy conservation, reduction in cost, or practical use of renewable energy.

In Japan, feed in tariff (FIT) for renewable energy started on Jul. 1, 2012. Under the system, in a double power generation mode contract, a power selling amount derived from the PV system can be increased by covering the energy demand in PV power generation with discharge of the rechargeable battery. Specifically, in the double power generation mode, a push-up effect for the power selling amount can be expected by discharging private power-generation facilities. The double power generation mode has a form in which private power-generation facilities (such as a rechargeable battery) are placed together with the PV system.

To pursue reduction in heating and lighting expenses under such a condition, it is necessary to make a discharge strategy for the rechargeable battery, with the push-up effect taken into consideration. To prepare a discharge strategy, it is required to consider estimated values of an energy demand and a PV power generation amount of a customer's home. However, estimated values are different from values (actual values) in actual use in many cases, and there are cases where expected reduction in heating and lighting expenses cannot be achieved.

BRIEF DESCRIPTION OF THE DRAWINGS

FIG. 3 is a diagram illustrating an example of a charge/discharge efficiency table of a rechargeable battery system 4;

FIG. 4A is a diagram illustrating an example of values of the power purchase unit price for respective time periods;

FIG. 4B is a diagram illustrating an example of a purchase price for surplus power generated by PV module 2;

DETAILED DESCRIPTION

In general, according to an embodiment, an energy management system manages energy of a customer's home including an energy storage apparatus and an energy generator. The energy management system includes an estimating module, a preparing module, and a controller. The estimating module estimates an energy demand of the customer's home, and obtains an estimated value of the energy demand. The estimating module estimates a generation amount of energy of the energy generator, and obtains an estimated value of the generation amount. The preparing module prepares a discharge strategy, based on the estimated value of the energy demand and the estimated value of the generation amount. The discharge strategy is capable of maximizing a balance obtained by subtracting a power purchase loss from a power selling profit, by using a push-up effect for a power selling amount obtained by discharge of the energy storage apparatus. The controller controls discharge of the energy storage apparatus, based on an actual value of the energy demand, an actual value of the generation amount, and the discharge strategy.

First Embodiment

Figure 1:
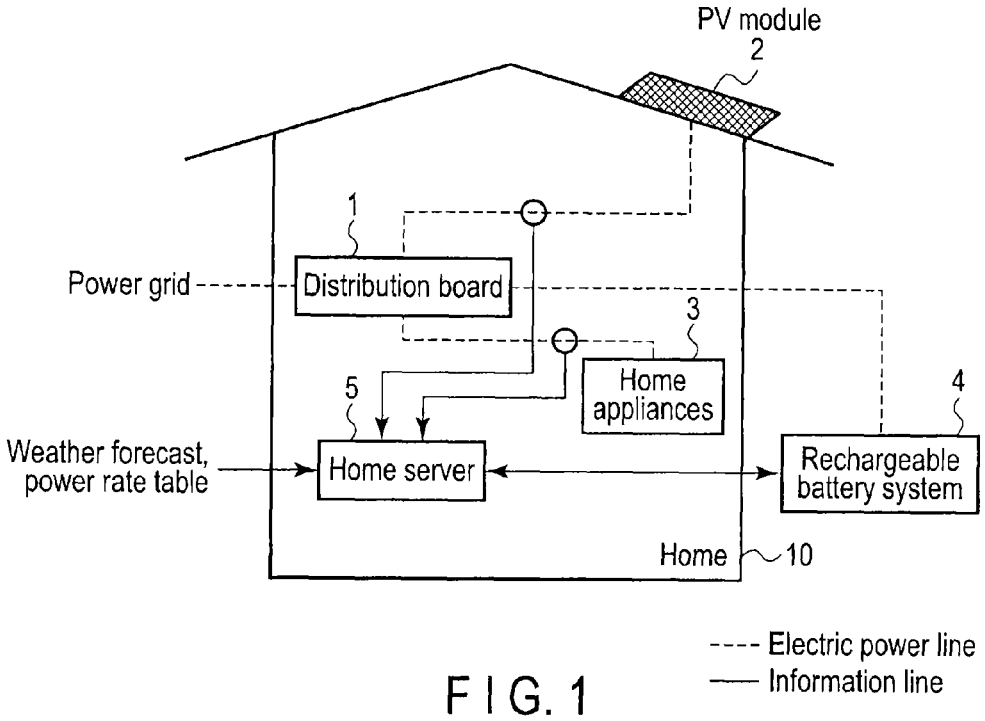
FIG. 1 is a block diagram illustrating an example of an energy management system according to a first embodiment.

FIG. 1 is a block diagram illustrating an example of an energy management system according to a first embodiment. The energy management system manages energy consumption in a home 10 of a customer. The home 10 includes a PV module 2 serving as an energy generator, and a rechargeable battery system 4 serving as an energy storage apparatus. Suppose that the customer's home has made a double power generation contract with an electric power company.

The home 10 also includes home appliances 3, a distribution board 1, and a home server 5, in addition to the PV module 2 and the rechargeable battery system 4. The PV module 2, the rechargeable battery system 4, and the home appliances 3 are connected to a power grid via the distribution board 1.

The PV module 2 converts a generated direct-current electric power into an alternating current by a power conditioning system (PCS), which is not shown, and feeds the alternating current to an electric power line in the home. The electric power generated by the PV module 2 is consumed by the home appliances 3, used to charge the rechargeable battery system 4, and supplied to reverse flow into a commercial electric power grid. More electric power selling profit can be obtained by securing the maximum reverse flow electric power with push-up effect.

The rechargeable battery system 4 includes a PCS (not shown), which is capable of converting direct-current electric power into alternating-current electric power, and converting alternating-current electric power into direct-current electric power. The rechargeable battery system 4 converts alternating-current electric power supplied from the power grid or the PV module 2 into direct-current electric power, and stores the electric power in itself. Electric power stored in the rechargeable battery system 4 is converted into alternating-current electric power, and covers the energy demand of the customer's home.

The home server 5 communicates with the PV module 2, the rechargeable battery system 4, the home appliances 3, and the distribution board 1, via information lines. A representative communication protocol used is ECHONET Lite (Registered Trademark). The electric power lines can be used as information lines, by using a power line communication (PLC) technique.

The home server 5 is also connected to a communication network, and receives information, such as weather forecast and a power rate table, from the communication network. The communication network is an IP (Internet Protocol) network or the Internet. The home server 5 generates charge/discharge instructions for the rechargeable battery system 4, based on these information items, and information such as the PV power generation amount, the power consumed by the home appliances 3, the demanded power, and a remaining quantity of the power stored in the rechargeable battery system 4. The rechargeable battery system 4 executes charge operation and discharge operation based on the instructions.

Figure 2:
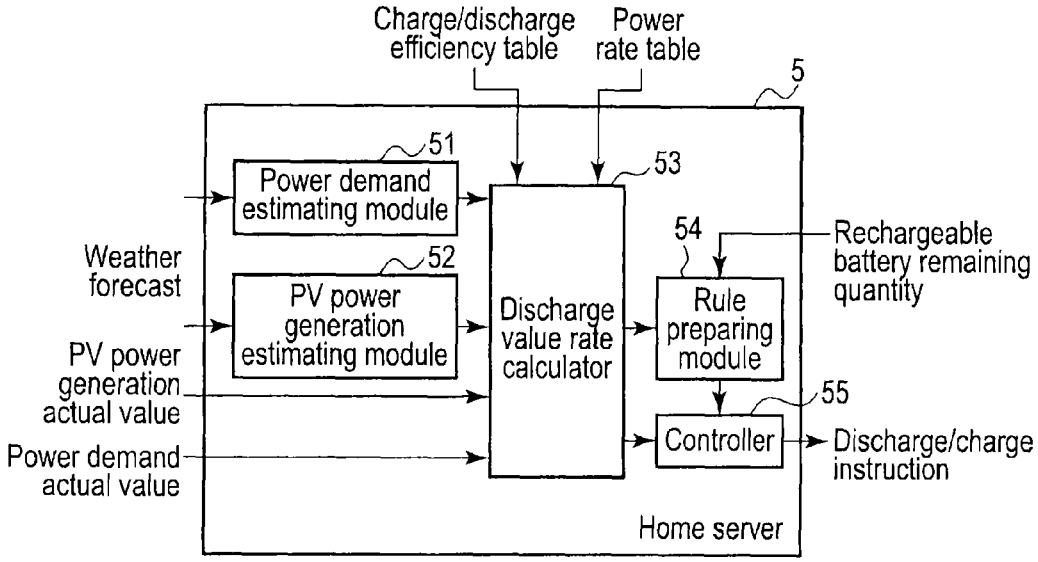
FIG. 2 is a functional block diagram illustrating an example of a home server 5 illustrated in FIG. 1.

FIG. 2 is a functional block diagram illustrating an example of the home server 5. The home server 5 includes an energy demand estimating module 51, a PV power generation estimating module 52, a discharge value rate calculator 53, a rule preparing module 54, and a controller 55.

The energy demand estimating module 51 estimates energy demand in the customer's home (hereinafter referred to as "energy demand"), and obtains an estimated value of the energy demand. The energy demand estimating module 51 estimates an energy demand of the next day based on, for example, a history of the past energy demand of the home 10. For example, the energy demand estimating module 51 can use the energy demand of the same day of the week in the last week as the next day, as an energy demand estimated value for the next day.

As another example, the energy demand estimating module 51 estimates an energy demand required on and after a certain time of the day, based on the energy demand required up to the certain time of the day, for which estimation is to be performed. To obtain the energy demand required on and after the certain time of the day, an energy demand curve similar to the energy demand curve obtained up to the certain time is retrieved from the past history. A part of the matched demand curve, which corresponds to the certain time and the following time, can be used as the estimated value.

The method for estimating the energy demand is not limited to the above methods, but other various methods may be used. It is also possible to correct the obtained energy demand estimated value by using weather forecast or the like.

The PV power generation estimating module 52 estimates a power amount generated by the PV module 2 (hereinafter referred to as "power generation amount"), and obtains a power generation amount estimated value. For example, the PV module 2 can calculate a power generation amount estimated value, based on the past achievement value of the power generation amount of the PV module 2, and weather forecast. For example, a method of estimating insolation amount by using weather forecasts every three hours is known.

The discharge value rate calculator 53 calculates a discharge value and a discharge value rate. The discharge value is an index to estimate a power selling profit with push-up effect included. The discharge value rate is a discharge value per unit electric power amount.

In addition, the discharge value rate calculator 53 calculates both an estimated value and an actual value being an actually-obtained value, for each of the discharge value and the discharge value rate. Specifically, the discharge value rate calculator 53 calculates an estimated value of the discharge value, an estimated value of the discharge value rate, an actual value of the discharge value, and an actual value of the discharge value rate.

An estimated value of the discharge value is calculated as a sum of a cancel amount of the power purchase loss in the case of covering the energy demand estimated value with discharge of the rechargeable battery system 4, and a power selling profit based on the estimated value of the PV power generation amount. To calculate an estimated value of the discharge value, the discharge value rate calculator 53 refers to a charge/discharge efficiency table illustrated in FIG. 3, and power rate tables illustrated in FIG. 4A and FIG. 4B, in addition to the energy demand estimated value and the power generation amount estimated value.

The charge/discharge efficiency table is a table in which a value of power (discharge power) to charge the rechargeable battery system 4 is correlated with charging (discharging) efficiency for the power of the value. FIG. 3 shows that the charging efficiency and the discharging efficiency for a power of 500 W are 0.8. Values which are not shown in the table of FIG. 3 can be determined by interpolation.

The power rate table is a list of power rates for respective time periods. FIG. 4A illustrates an example of values of power purchase unit prices for respective time periods. In the contract illustrated in FIG. 4A, the power rate in a time period including the daytime demand peak is more than three times as high as the power rate at night. FIG. 4B is a diagram illustrating an example of the purchase price for surplus power generated by the PV module 2. FIG. 4B shows that the power purchase price is uniformly 34 yen, regardless of the time period.

An estimated value of the discharge value rate is calculated by dividing the estimated value of the discharge value by a discharge amount (estimated value of the energy demand) of the rechargeable battery system 4.

The actual value of the discharge value rate is calculated as a sum of a cancel amount of power purchase loss under the condition that the actual value of the energy demand is covered with discharge of the rechargeable battery system 4, and a power selling profit based on the actual value of the PV power generation amount. The actual value of the discharge value rate is a value obtained by dividing the actual value of the discharge value by the actual value of the energy demand.

The rule preparing module 54 determines a discharge rule for the rechargeable battery system, based on the estimated value of the discharge value rate and the charge remaining quantity of the rechargeable battery system 4, and supplies the discharge rule to the controller 55. The controller 55 discharges the rechargeable battery system 4 based on the discharge rule and the actual value of the discharge value rate.

The discharge value rate calculator 53 and the rule preparing module 54 function as a preparing module. The preparing module prepares a discharge strategy for the rechargeable battery system 4, based on an estimated value of the energy demand and an estimated value of the power generation amount. A profitable discharge strategy can be prepared by using the discharge value rate calculated by the discharge value rate calculator 53. The term "profitable discharge strategy" means a discharge strategy to maximize a balance obtained by subtracting the power purchase loss from the power selling profit with good use of the push-up effect.

The controller 55 controls discharge of the rechargeable battery system 4, based on the estimated value of the energy demand, the actual value of the power generation amount, and the discharge strategy. The rechargeable battery system 4 charges and discharges the battery, in accordance with charge/discharge instructions provided from the controller 55.

The home server 5 can be fabricated by using, for example, a general-purpose computer as basic hardware. Specifically, each functional block in the home server 5 can be provided by causing a CPU (Central Processing Unit) of the computer to execute a program. The home server 5 can be fabricated by installing the program in advance in the computer. As another example, the home server 5 may be fabricated by installing the program, which is stored in a storage medium such as a CD-ROM or distributed through a network, in the computer.

Figure 5:
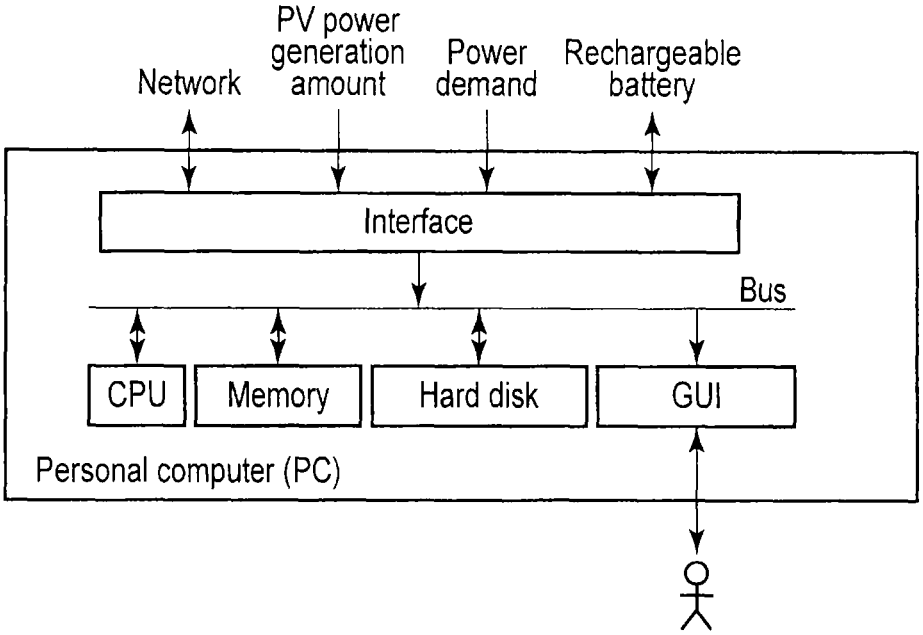
FIG. 5 is a diagram illustrating an example of a hardware block of the home server 5 illustrated in FIG. 1.

As illustrated in FIG. 5, the computer includes a CPU, a memory, a hard disk, an interface (IF), and a graphic interface (GUI), which are connected through a bus. A program that executes the function of the home server 5 is stored on the hard disk, expanded in the memory when executed, and then executed in accordance with a process. The home server 5 includes an interface to measure the PV power generation amount and the energy demand required by the home appliances 3, an interface with the rechargeable battery system 4, and an interface with the network.

In particular, the home server 5 may include a power conditioning system, in addition to the functional blocks illustrated in FIG. 2. In such a form, the home server 5 may be fabricated as an embedded apparatus, and placed outdoors.

Figure 6:
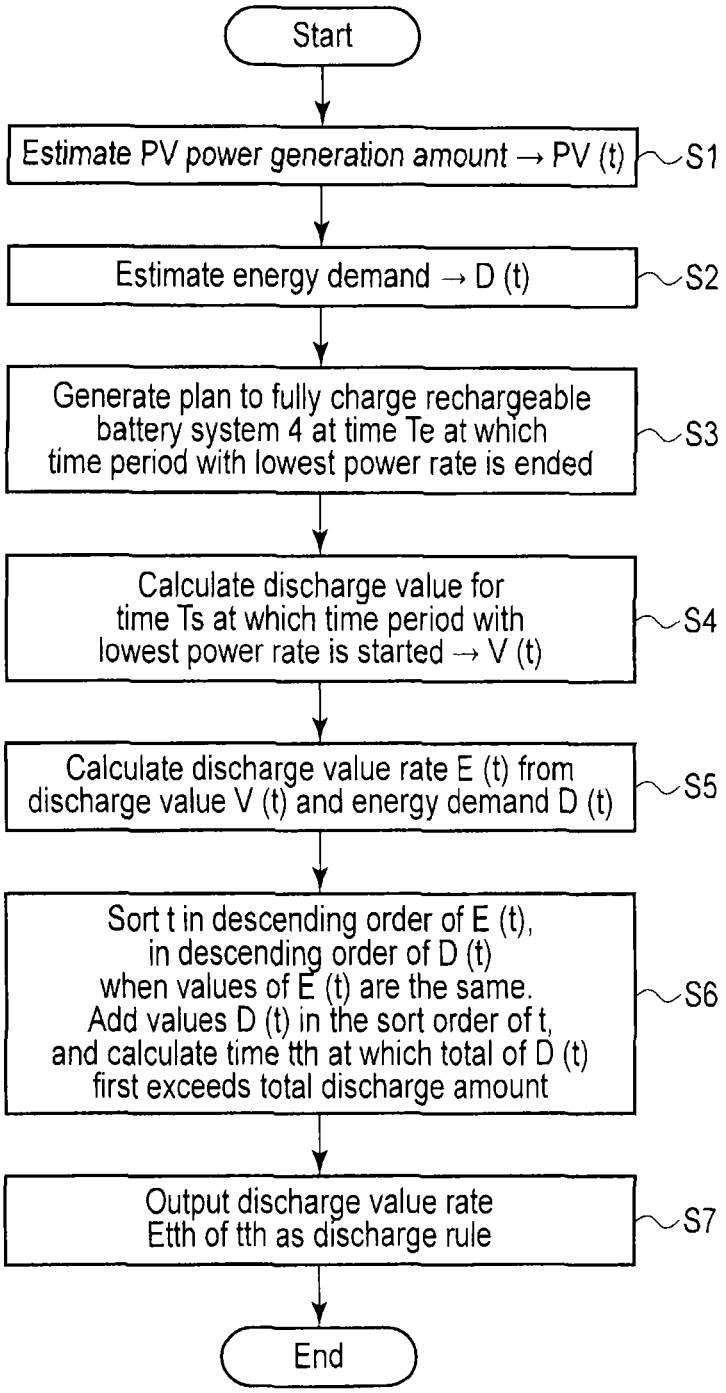
FIG. 6 is a flowchart illustrating an example of a process relating to generation of a discharge rule.

FIG. 6 is a flowchart illustrating an example of a process relating to preparation of the discharge rule. The PV power generation estimating module 52 calculates an estimated value of the PV power generation amount (Step S1), and obtains a time series PV (t) thereof. The energy demand estimating module 51 calculates an estimated value of the energy demand (Step S2), and obtains a time series D (t) thereof.

The reference symbol t is a variable representing a time in a day. For example, supposing that a day (standard period of time) is denoted by a set of one minutes (unit period), t has a value of 0 to 1439.

Next, the rule preparing module 54 prepares a discharge rule for the rechargeable battery system 4. To minimize the power purchase loss, the rule preparing module 54 determines a discharge rule to finish charging for the shortest period of time in a time period with an inexpensive power rate. Supposing that the time at which the time period with the lowest power rate is ended is Te, the rule preparing module 54 generates a plan to fully charge the rechargeable battery system 4 at Te.

Figure 7A:
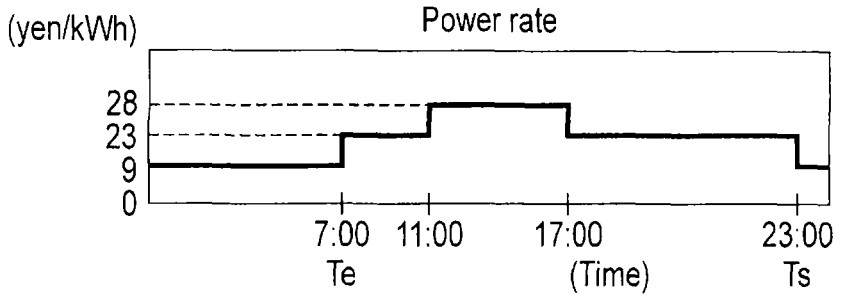
FIG. 7A is a graph illustrating a power rate table illustrated in FIG. 4A.
Figure 7B:
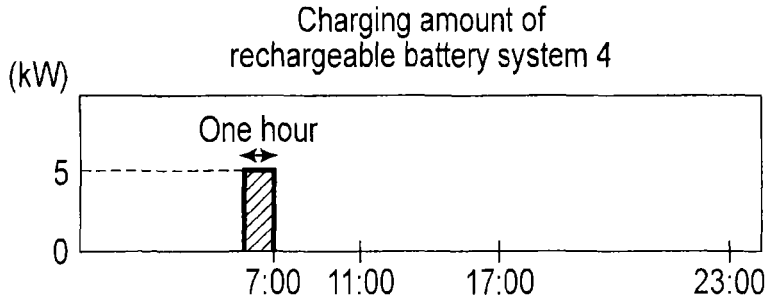
FIG. 7B is a diagram illustrating a charge plan for the rechargeable battery system 4.

FIG. 7A is a graph illustrating the power rate table illustrated in FIG. 4A. In FIG. 7A, Te is 7 A.M. Suppose that the remaining quantity of the rechargeable battery system 4 before charging is zero, the capacity of the battery is 5 kWh, and the chargeable power is 5 kW. As illustrated in FIG. 7B as an example, it is possible to make a plan to charge the rechargeable battery system 4 with 5 kW from 6:00 to 7:00.

Next, the discharge value rate calculator 53 calculates a time series for the discharge value estimated value V (t) based on the following expressions (1) to (4) (Step S4). In the first embodiment, a time series from the time Te to time Ts at which the time period with the lowest power rate is started is calculated. Specifically, values for one minutes being a unit period of time are calculated as V (t).

[Equation 1]

$$PV_{ov}D(t) = PV(t) - D(t) \quad (PV(t) > D(t)) \qquad (1)$$
$$= 0 \quad (PV(t) \leqq D(t))$$

$$D_{ov}PV(t) = D(t) - PV(t) \quad (D(t) > PV(t)) \qquad (2)$$
$$= 0 \quad (D(t) \leqq PV(t))$$

$$PV_{push}(t) = \min(PV(t), D(t)) \qquad (3)$$

$$V(t) = PV_{push}(t) \times PR_{sell} + D_{ov}PV(t) \times PR(t) \qquad (4)$$

$PV_{ov}D$ (t) in expression (1) is a series which is a difference between them in the case where the estimated value of the PV power generation amount exceeds the estimated value of the energy demand, and 0 in the case where the estimated value of the PV power generation amount is equal to or less than the estimated value of the energy demand.

$D_{ov}PV$ (t) in expression (2) is a series which is a difference between them in the case where the estimated value of the energy demand exceeds the estimated value of the PV power generation amount, and 0 in the case where the estimated value of the energy demand is equal to or less than the estimated value of the PV power generation amount.

$PV_{push}$ (t) in expression (3) is a smaller value among PV (t) and D (t). The $PV_{push}$ (t) is a series of a power generation amount which can push up the PV power selling amount by covering the estimated value of the energy demand with discharge of the rechargeable battery system 4.

V (t) in expression (4) is a value obtained by discharging the rechargeable battery for D (t) minutes at the time, that is, the discharge value. In expression (4), $PR_{sell}$ represents a PV sell power purchase price, and PR (t) represents a power rate. The first term of the right side represents a power selling price for the pushed-up PV power generation amount, and an estimated value of the power selling profit based on the power generation amount of the PV module 2. The second term of the right side represents a cancel amount of the power purchase loss in the case where the estimated value of the energy demand is covered with discharge of the rechargeable battery system 4.

Figure 8A:
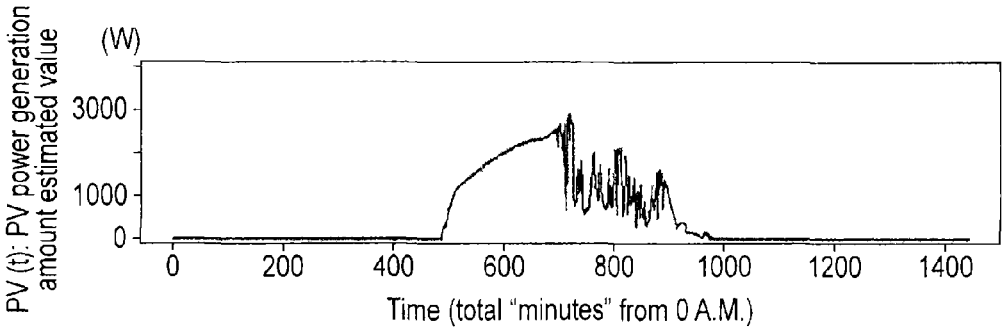
FIG. 8A is a graph illustrating an example of a PV power generation amount estimated value PV (t)
Figure 8B:
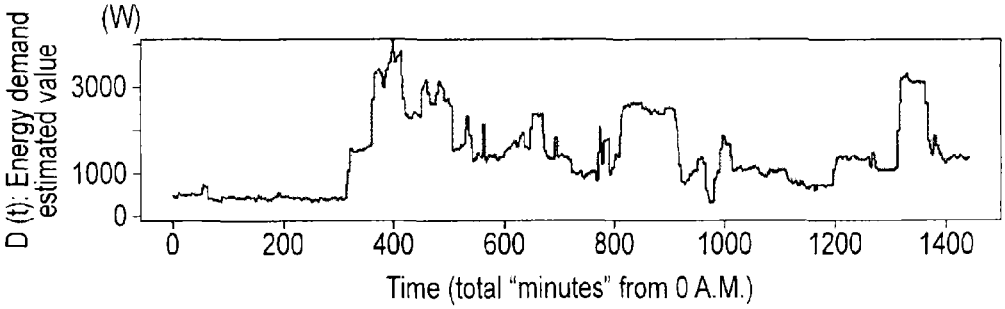
FIG. 8B is a graph illustrating an example of an energy demand estimated value D (t)
Figure 8C:
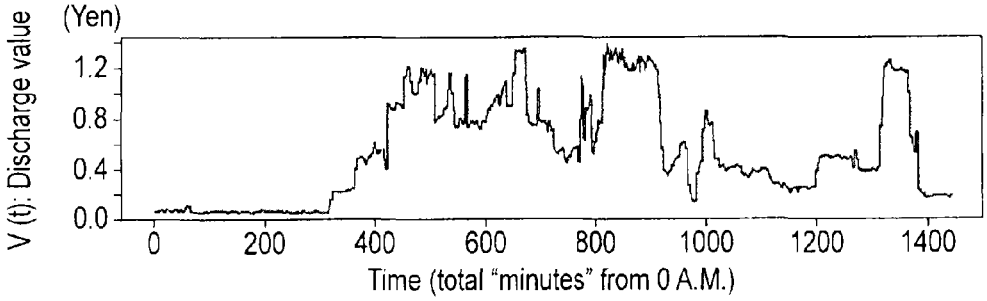
FIG. 8C is a graph illustrating an example of a discharge value V (t)

FIG. 8A is a graph illustrating an example of the PV power generation amount estimated value PV (t). FIG. 8B is a graph illustrating an example of the energy demand estimated value D (t). FIG. 8C is a graph illustrating an example of the discharge value V (t). The discharge value V (t) is calculated based on expression (4), by using PV (t), D (t), PR (t) illustrated in FIG. 4A, and $PR_{sell}$ illustrated in FIG. 4B. In each of the graphs of FIG. 8A, FIG. 8B, and FIG. 8C, the horizontal axis indicates time, and a cumulative value of "minutes" summed up from 0 A.M. The vertical axis indicates a value for each minute.

With reference to FIG. 6 again, next, the discharge value rate calculator 53 calculates a time series of a discharge value rate estimated value E (t) based on expression (5), from the discharge value V (t) and the energy demand D (t) (Step S5). Specifically, E (t) is a value obtained by dividing V (t) by the discharge amount (or estimated value of the energy demand).

[Equation 2]

$$E(t)=V(t)/f(D(t)) \tag{5}$$

F (D (t)) in expression (5) is a function indicating a discharge power amount, which is actually discharged from the rechargeable battery system 4 to obtain the power of D (t). For example, supposing that the discharge efficiency for 1 kW is 95%, the expression "f (1 kW)=1.052 kW" is established. The value obtained by conversion with the function f is obtained by using the charge/discharge efficiency table illustrated in FIG. 3.

Figure 9:
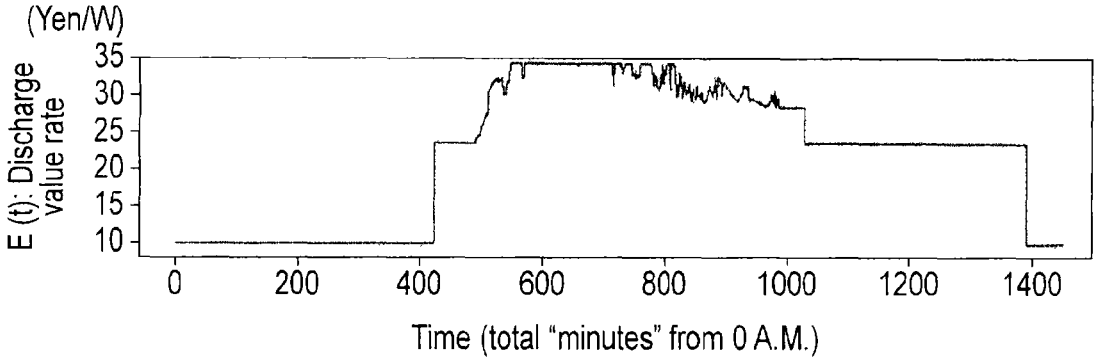
FIG. 9 is a graph illustrating an example of a discharge value rate estimated value E (t)

FIG. 9 is a graph illustrating an example of a discharge value rate estimated value E (t). In the example, the charge/discharge efficiency is set to 1. The graph illustrated in FIG. 9 shows E (t) from Te (7:00) to Ts (23:00). For example, E (t) has a higher value around 600 minutes (10:00) than a value on and after 1020 minutes (17:00). This shows that discharging the rechargeable battery system 4 around 600 minutes achieves higher efficiency. Specifically, discharging the rechargeable battery system 4 around 600 minutes further increases a balance between the power selling profit and the power purchase loss.

Next, the discharge value rate calculator 53 sorts the time indexes t in the descending order of the value of E (t). When some indexes have the same value of E (t), the time index t having a larger energy demand estimated value D (t) is provided with a higher order. Then, the discharge value rate calculator 53 accumulates the values of D (t) in the order of sorted indexes t, and calculates the time $t_{th}$ at which the sum of the values D (t) first exceeds the charging amount (dischargeable amount) of the rechargeable battery system 4 (Step S6).

Specifically, the discharge value rate calculator 53 specifies the time $t_{th}$, at which the sum of successive addition of the values D (t) from the time t with the highest discharge value rate estimated value E (t) becomes equal to or higher than the total discharge amount of the day of the rechargeable battery system 4. Suppose that E (t) at the time $t_{th}$ is $Et_{th}$. $Et_{th}$ is a threshold to determine whether to discharge the rechargeable battery system 4 or not.

In the example of FIG. 9, $t_{th}$ is 667 minutes, and E (667) at $t_{th}$ is 33.96 (yen/kWh). Specifically, the threshold is 33.96 yen/kW. As explained above, in the first embodiment, the discharge rule of the day being an estimation target is determined as "rechargeable battery system 4 is discharged when the actual value of the discharge value rate E becomes equal to or larger than 33.96". The discharge value rate calculator 53 supplies the threshold $Et_{th}$ (=33.96) to the controller 55 (Step S7).

Figure 10:
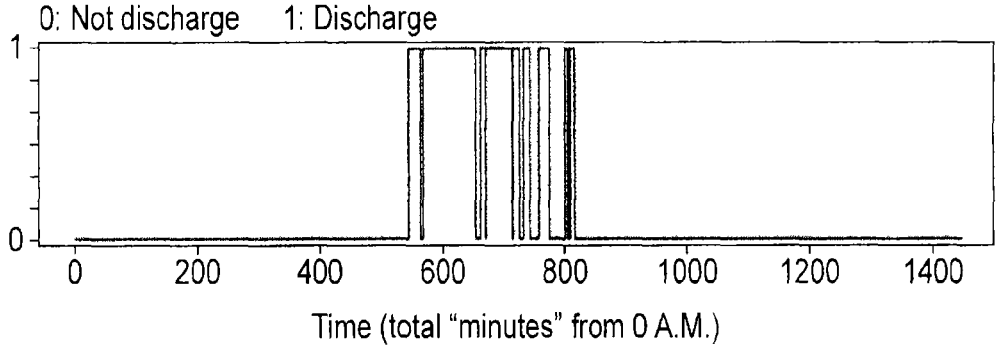
FIG. 10 is a diagram illustrating an example of discharge on/off control for the rechargeable battery system 4.

FIG. 10 is a diagram illustrating an example of control to turn on/off discharge of the rechargeable battery system 4. Digit 1 represents performing discharge (discharge on), and digit 0 represents performing no discharge (discharge off). FIG. 10 shows that more minute discharge control is performed than existing control based on the PV power generation amount. FIG. 10 is based on the assumption that the PV power generation amount estimation and the energy demand estimation are accurate, and that the discharge amount is equal to the energy demand of each time.

Discharge control as illustrated in FIG. 10 is achieved by calculating the threshold $Et_{th}$ serving as the discharge rule. The discharge strategy based on the threshold $Et_{th}$ is a strategy of distributing the discharge amount of the rechargeable battery system 4 to respective time periods, obtained by dividing the day by one minute, in the order of the value of E (t), from the highest.

Figure 11:
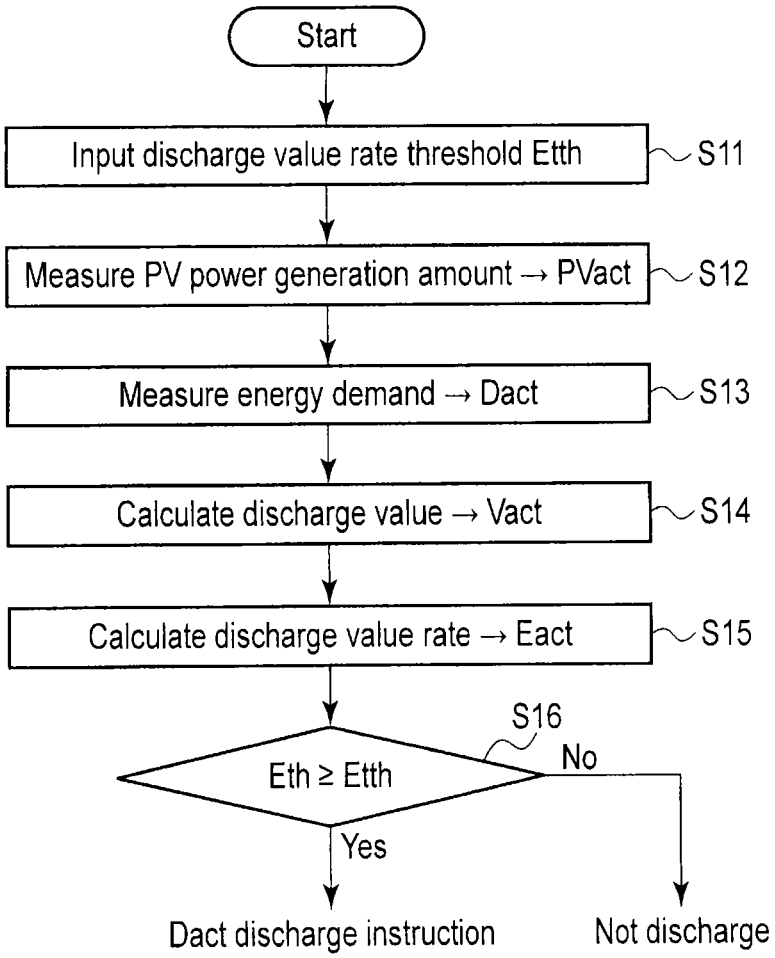
FIG. 11 is a flowchart illustrating an example of a process performed by a controller 55.

FIG. 11 is a flowchart illustrating an example of a process performed by the controller 55. The controller 55 performs control to turn on/off discharge of the rechargeable battery system 4, based on the threshold $Et_{th}$. With respect to charging, it suffices that the rechargeable battery system 4 is fully charged in a time period at night with a low power rate.

Discharge control will be explained hereinafter. The controller 55 obtains threshold $Et_{th}$ serving as the discharge rule (Step S11). Next, the controller 55 obtains the actual value ($PV_{act}$) of the PV power generation amount and the actual value ($D_{act}$) of the energy demand (Steps S12, S13). $PV_{act}$ is measured by, for example, a sensor contained in the PV module 2, or a sensor contained in the PCS connected to the PV module 2. $D_{act}$ is measured by, for example, a sensor connected to the distribution board 1.

Next, the controller 55 determines a discharge value of the present time, that is, the actual value $V_{act}$ of the discharge value by expressions (6) to (9) (Step S14). The symbol "act" attached to the expressions (6) to (9) and (10) indicates that the value is an actual value.

[Equation 3]

$$PV_{ov}D_{act} = PV_{act} - D_{act} \quad (PV_{act} > D_{act}) \tag{6}$$
$$= 0 \quad (PV_{act} \geqq D_{act})$$

$$D_{ov}PV_{act} = D_{act} - PV_{act} \quad (D_{act} > PV_{act}) \tag{7}$$
$$= 0 \quad (D_{act} \leqq PV_{act})$$

$$PV_{pushact} = \min \quad (PV_{act}, D_{act}) \tag{8}$$

$$V_{act} = PV_{pushact} \times PR_{sell} + D_{ov}PV_{act} \times PR \text{ (present time)} \tag{9}$$

$PV_{ov}D_{act}$ in expression (6) is a series which is a difference between them in the case where the actual value of the PV power generation amount exceeds the actual value of the energy demand, and 0 in the case where the actual value of the PV power generation amount is equal to or less than the actual value of the energy demand.

$D_{ov}PV_{act}$ in expression (7) is a series which is a difference between them when the actual value of the energy demand exceeds the actual value of the PV power generation amount, and 0 in the case where the actual value of the energy demand is equal to or less than the actual value of the PV power generation amount.

$PV_{pushact}$ in expression (8) is a smaller value among $PV_{act}$ and $D_{act}$. The $PV_{pushact}$ is a series of the power generation amount which can push up the PV power selling amount by covering the actual value of the energy demand with discharge of the rechargeable battery system 4.

$V_{act}$ in expression (9) is a value obtained by discharging the rechargeable battery system for $D_{act}$ minutes at the present time, that is, the discharge value.

Next, the controller 55 calculates an actual value $E_{act}$ of the discharge value rate, based on expression (10), from $V_{act}$ and $D_{act}$ (Step S15).

[Equation 4]

$$E_{act}=V_{act}/f(D_{act}) \quad (10)$$

$E_{act}$ is a value obtained by dividing a sum of the cancel amount of the power purchase loss and the power selling profit based on $PV_{act}$ in the case where $D_{act}$ is covered with discharge of the rechargeable battery system 4 by the discharge amount with the efficiency taken into consideration. The denominator of expression (10) may be the energy demand actual value $D_{act}$.

When $E_{act}$ is equal to or larger than $Et_{th}$, the controller 55 supplies a discharge instruction to the rechargeable battery system 4, to discharge the power for $D_{act}$. When $E_{act}$ is smaller than $Et_{th}$, the controller 55 determines that performing discharge at the time is less valuable, and does not perform discharge.

As described above, according to the first embodiment, a discharge value is calculated as an index for estimating a net power selling profit (or power purchase loss) with the push-up effect taken into consideration. Then, the discharge value rate being the discharge value per discharge amount is calculated. Thereafter, a discharge strategy which can maximize the power selling profit (or minimize the power purchase loss) is prepared, based on the discharge value rate.

Specifically, it is possible to prepare a discharge rule which enables discharge of the limited power of the rechargeable battery system 4 in a time period with a high discharge value. Thus, according to the first embodiment, it is possible to maximize a net profit obtained by power selling.

The discharge rule is provided by the discharge value rate threshold $Et_{th}$. It is determined whether to discharge the rechargeable battery system 4 or not, based on whether the actual value of the discharge value rate is equal to or larger than the threshold $Et_{th}$ or not. Thereby, the number of rules is reduced in comparison with the existing technique of controlling discharge by the time, and resources are saved.

For example, the time illustrated in FIG. 10 indicates the discharge time in the case where the PV power generation estimation and the energy demand estimation are completely correct. However, since it is difficult to completely estimate them, discharge may be performed at the time with a low discharge value rate, or discharge may not be performed at the time with a high discharge value rate, in the case where the plan is made based on the time. Specifically, an operation plan that is made based on the estimation value may not achieve expected reduction in heating and lighting expenses, due to a difference between the value in actual operation and the estimated value.

In comparison with this, in the present embodiment, whether to perform discharge or not is determined based on the discharge value rate. Thus, a valid discharge strategy is made on average, even when the PV power generation amount estimated value and the energy demand estimated value are different from their actual values. Specifically, according to the first embodiment, discharge control is performed based on the discharge value, which is a completely new index, not the discharge time based on estimation. In addition, whether to perform discharge or not is determined by comparing the actual value with the threshold value. Thus, it is possible to achieve control, by which reduction in heating and lighting expenses can still be expected even when the estimated value is alienated from the actual value.

Based on the above, it is possible to provide an energy management system, an energy management method, a program, a server apparatus, and a local server, which enable operation of an energy storage apparatus under a profitable discharge strategy.

Second Embodiment

Figure 12:
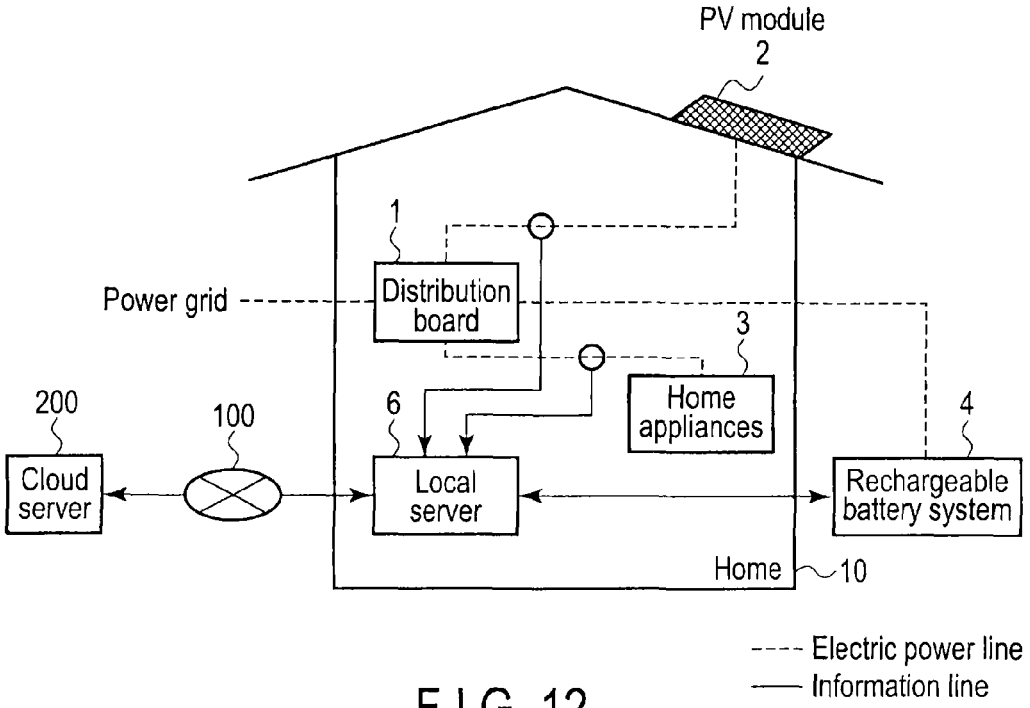
FIG. 12 is a block diagram illustrating an example of an energy management system according to a second embodiment.

FIG. 12 is a block diagram illustrating an example of an energy management system according to a second embodiment. In FIG. 12, constituent elements which are the same as those in FIG. 1 are denoted by the same respective reference numerals, and only constituent elements different from FIG. 1 will be explained hereinafter. In the second embodiment, the function achieved by the first embodiment is achieved by cooperation of a cloud server 200 included in a cloud computing system and a local server 6 installed in a home. The cloud server 200 is connected to the local server 6 via a communication network 100, such as the Internet and an IP (Internet Protocol)-VPN (Virtual Private Network).

Figure 13:
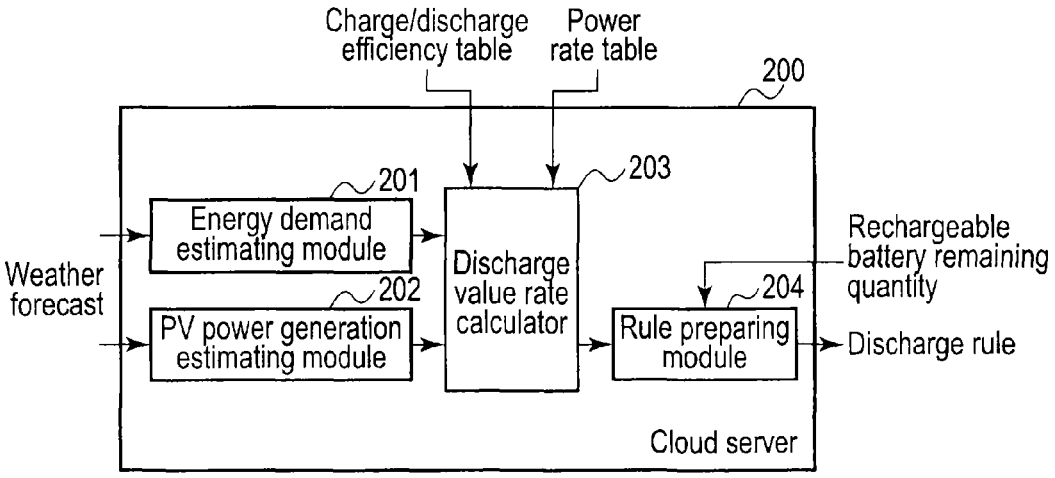
FIG. 13 is a functional block diagram illustrating an example of a cloud server 200.

FIG. 13 is a functional block diagram illustrating an example of the cloud server 200. The cloud server 200 includes an energy demand estimating module 201, a PV power generation estimating module 202, a discharge value rate calculator 203, and a rule preparing module 204. The energy demand estimating module 201 and the PV power generation estimating module 202 have the same functions as those of the energy demand estimating module 51 and the PV power generation estimating module 52 illustrated in FIG. 1, respectively. As an advantage peculiar to the second embodiment, the energy demand estimating module 201 and the PV power generation estimating module 202 can use a massive database and computer resources included in the cloud computing system. By this advantage, it can be expected to obtain more accurate estimated values for both of the energy demand and the PV power generation amount.

The discharge value rate calculator 203 calculates a time series of the estimated value of the discharge value rate, in the same manner as the first embodiment. The rule preparing module 204 calculates a threshold $Et_{th}$ of the discharge value rate, in the same manner as the first embodiment. In addition, the rule preparing module 204 also has a function as a notification module that notifies the local server 6 of the threshold $Et_{th}$ serving as the discharge rule (discharge strategy) via the communication network 100. The rule preparing module also obtains a rechargeable battery remaining quantity of the rechargeable battery system 4 from the local server 6 via the communication network 100, and uses it for preparation of the discharge strategy.

Figure 14:
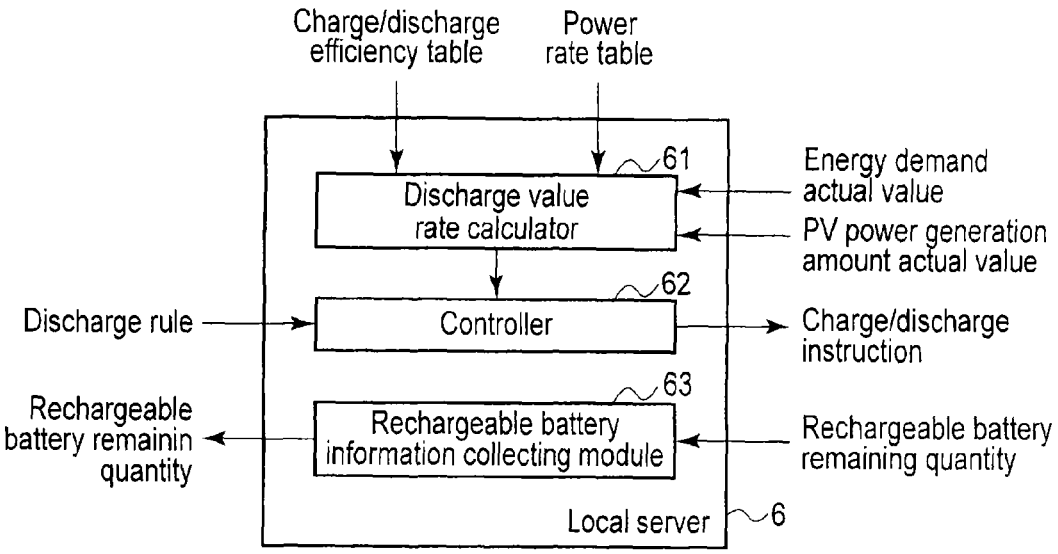
FIG. 14 is a functional block diagram illustrating an example of a local server 6.

FIG. 14 is a functional block diagram illustrating an example of the local server 6. The local server 6 includes a discharge value rate calculator 61, a controller 62, and a rechargeable battery information collecting module 63. The discharge value rate calculator 61 calculates an actual value of the discharge value rate in the same manner as the first embodiment, based on actual values of the energy demand and the PV power generation amount.

The controller 62 has a function as an interface that receives the threshold $Et_{th}$ transmitted from the cloud server. In addition, the controller 62 controls discharge of the rechargeable battery system 4, based on the obtained threshold $Et_{th}$. The rechargeable battery information collecting module 63 obtains information, such as the current state and the rechargeable battery remaining quantity of the rechargeable battery system 4, and notifies the cloud server 200 of the information via the communication network 100.

Figure 15:
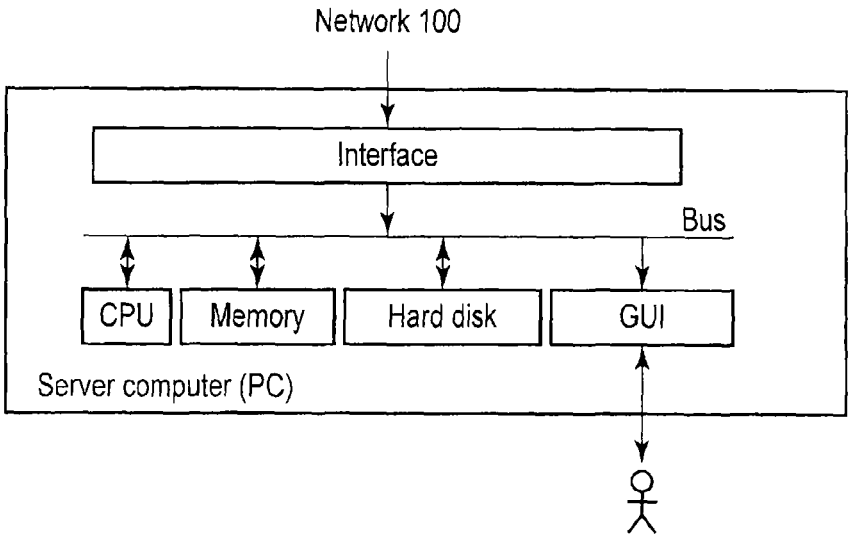
FIG. 15 is a diagram illustrating an example of a hardware block of the cloud server 200.

As illustrated in FIG. 15, the cloud server 200 includes a CPU, a memory, a hard disk, an interface, a GUI, and a bus connecting them. A program which achieves the function of the cloud server 200 is stored on the hard disk, expanded in the memory when executed, and then executed in accordance with the process.

The cloud server 200 includes an interface connected to the network 100. The cloud server 200 communicates with the local server 6 via the interface. Specifically, the cloud server 200 notifies the local server 6 of the threshold $Et_{th}$ via the interface, and obtains the remaining quantity of the rechargeable battery from the local server 6.

Figure 16:
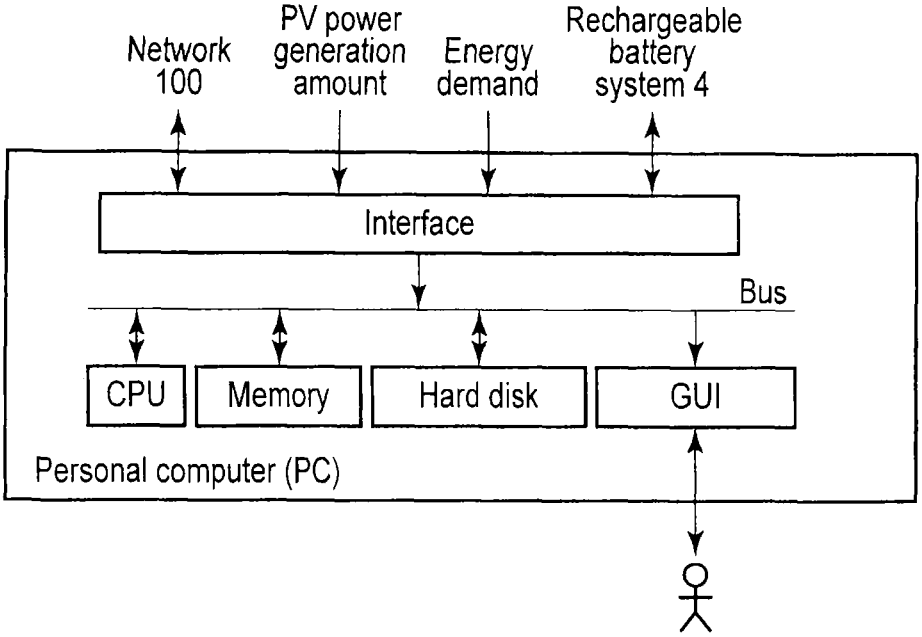
FIG. 16 is a diagram illustrating an example of a hardware block of the local server 6.

As illustrated in FIG. 16, the local server 6 includes a CPU, a memory, a hard disk, an interface, a GUI, and a bus connecting them. A program which achieves the function of the local server 6 is stored on the hard disk, expanded in the memory when executed, and then executed in accordance with the process.

The local server 6 includes an interface that is connected to the information line of the home 10, obtains the PV power generation amount and the energy demand, and communicates with the rechargeable battery system 4. In addition, the local server 6 includes an interface that is connected to the network 100. The local server 6 communicates with the cloud server 200 via the interface. Specifically, the local server 6 obtains the threshold $Et_{th}$ from the cloud server 200 via the interface, and notifies the cloud server 200 of the remaining quantity of the rechargeable battery.

As described above, according to the second embodiment, functional objects relating to the energy management system are distributed to the cloud server 200 and the local server 6, and their interfaces are provided. Specifically, the discharge strategy is determined in the cloud server 200, and the discharge rule is transmitted to the local server via the interface. In addition, information necessary for preparation of the discharge strategy is obtained in the cloud computing system, or transmitted from the local server to the cloud server 200 via the interface.

According to the above form, it is possible to use massive computer resources of the cloud computing system. For example, although there are cases where PV power generation estimation and energy demand estimation require heavy-load calculation, the second embodiment enables calculation of estimated values with high accuracy and for a short time. Using the PV power generation estimated value and the energy demand estimated value with high accuracy further improves validity of the discharge strategy, as a matter of course.

In view of the above, also according to the second embodiment, it is possible to provide an energy management system, an energy management method, a program, a server apparatus, and a local server, which enable operation of an energy storage apparatus under a profitable discharge strategy.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes may be made without departing from the spirit of the inventions. The accompanying claims and their equivalents are intended to cover such forms or modifications as would fall within the scope and spirit of the inventions.

The invention claimed is:

1. An energy management system which manages energy of a home, comprising:

processing circuitry configured as:

an energy demand estimator configured to estimate an energy demand of the home to obtain an estimated value of the energy demand;

a power generation estimator configured to estimate a generation amount of energy of an energy generator of the home to obtain an estimated value of the generation amount; and a preparer configured to prepare a discharge strategy capable of maximizing a balance between a power selling profit and a power purchase loss by using a push-up effect, and a controller configured to control discharge of an energy storage apparatus, based on an actual value of the energy demand, an actual value of the generation amount, and the discharge strategy, wherein the push-up effect is an effect to increase a power selling amount derived from the energy generator by covering the energy demand with discharge of the energy storage apparatus;

the preparer is further configured to:

calculate an estimated value of a discharge value for each of unit periods in a standard period of time, the estimating value of the discharge value being a sum of a cancel amount of the power purchase loss in case where the estimated energy demand is covered with discharge of the energy storage apparatus and a power purchase profit based on the estimated generation amount;

calculate an estimated value of a discharge value rate, which is a value obtained by dividing the estimated value of the discharge value by the discharge amount of the energy storage apparatus, for each of the unit periods;

prepare a discharge strategy to distribute the discharge amount of the energy storage apparatus to the respective unit periods, in descending order of estimated values of the discharge value rate;

specify a unit period at which a total of the estimated values of the energy demand becomes equal to or larger than the total discharge amount of the energy storage apparatus, the total being obtained by successively adding the estimated values of the energy demand from a unit period with a highest estimated value of the discharge value rate; and determine an estimated value of the discharge value rate in the specified unit period as a threshold, and the controller is further configured to:

calculate an actual value of the discharge value rate, which is obtained by dividing the discharge amount into a sum of a cancel amount of the power purchase loss in case where the actual value of the energy demand is covered with discharge of the energy storage apparatus and a power selling profit based on the actual value of the generation amount; and discharge the energy storage apparatus when the actual value of the discharge value rate is equal to or larger than the threshold.

2. The energy management system of claim 1, further comprising:

a local server provided in the home; and a cloud server capable of communicating with the local server via a network, wherein the cloud server includes the energy demand estimator, the power generation estimator, the preparer, and a notifier which notifies the local server of the discharge strategy via the network, and the local server includes the controller, and an interface which receives the notified discharge strategy.

3. An energy management method which manages energy of a home, comprising:

estimating an energy demand of the home, and obtaining an estimated value of the energy demand;

estimating a generation amount of energy of an energy generator of the home, and obtaining an estimated value of the generation amount;

preparing a discharge strategy capable of maximizing a balance between a power selling profit and a power purchase loss by using a push-up effect, and controlling a discharge of an energy storage apparatus, based on an actual value of the energy demand, an actual value of the generation amount, and the discharge strategy, wherein the push-up effect is an effect to increase a power selling amount derived from the energy generator by covering the energy demand with discharge of the energy storage apparatus;

the preparing includes:

calculating an estimated value of a discharge value for each of unit periods in a standard period of time, the estimating value of the discharge value being a sum of a cancel amount of the power purchase loss in case where the estimated energy demand is covered with discharge of the energy storage apparatus and a power purchase profit based on the estimated generation amount;

calculating an estimated value of a discharge value rate, which is a value obtained by dividing the estimated value of the discharge value by the discharge amount of the energy storage apparatus, for each of the unit periods;

preparing a discharge strategy to distribute the discharge amount of the energy storage apparatus to the respective unit periods, in descending order of estimated values of the discharge value rate;

successively adding the estimated values of the energy demand from a unit period with a highest estimated value of the discharge value rate;

specifying a unit period at which a total of the estimated values of the energy demand, which is obtained by the adding, becomes equal to or larger than the total discharge amount of the energy storage apparatus; and determining an estimated value of the discharge value rate in the specified unit period as a threshold, and the controlling includes:

calculating an actual value of the discharge value rate, which is obtained by dividing the discharge amount into a sum of a cancel amount of the power purchase loss in case where the actual value of the energy demand is covered with discharge of the energy storage apparatus and a power selling profit based on the actual value of the generation amount; and discharging the energy storage apparatus when the actual value of the discharge value rate is equal to or larger than the threshold.

4. A non-transitory computer-readable medium storing a program including a command to cause a computer to execute the method of claim 3.

5. A server apparatus which manages energy of a home, comprising:

processing circuitry configured as:

a energy demand estimator which estimates an energy demand of the home, and obtains an estimated value of the energy demand;

a power generation estimator which estimates a generation amount of energy of an energy generator of the home, and obtains an estimated value of the generation amount; and a preparer configured to prepare a discharge strategy capable of maximizing a balance between a power selling profit and a power purchase loss by using a push-up effect, and a controller configured to control discharge of an energy storage apparatus, based on an actual value of the energy demand, an actual value of the generation amount, and the discharge strategy, wherein the push-up effect is an effect to increase a power selling amount derived from the energy generator by covering the energy demand with discharge of the energy storage apparatus;

the preparer is further configured to:

calculate an estimated value of a discharge value for each of unit periods in a standard period of time, the estimating value of the discharge value being a sum of a cancel amount of the power purchase loss in case where the estimated energy demand is covered with discharge of the energy storage apparatus and a power purchase profit based on the estimated generation amount;

calculate an estimated value of a discharge value rate, which is a value obtained by dividing the estimated value of the discharge value by the discharge amount of the energy storage apparatus, for each of the unit periods;

prepare a discharge strategy to distribute the discharge amount of the energy storage apparatus to the respective unit periods, in descending order of estimated values of the discharge value rate specify a unit period at which a total of the estimated values of the energy demand becomes equal to or larger than the total discharge amount of the energy storage apparatus, the total being obtained by successively adding the estimated values of the energy demand from a unit period with a highest estimated value of the discharge value rate; and determine an estimated value of the discharge value rate in the specified unit period as a threshold, and a notifying module notifies the customer of the threshold.

6. A local server which is provided in a home, comprising:

processing circuitry configured to prepare a discharge strategy, based on the estimated value of energy demand and the estimated value of an energy generation amount in the home, the discharge strategy capable of maximizing a balance obtained by subtracting a power purchase loss from a power selling profit, by using a push-up effect for a power selling amount obtained by discharge of an energy storage apparatus in the home; and a controller which controls discharge of the energy storage apparatus, based on an actual value of the energy demand, an actual value of the generation amount, and the discharge strategy, wherein the push-up effect is an effect to increase a power selling amount derived from the energy generator by covering the energy demand with discharge of the energy storage apparatus;

the processing circuitry is further configured to:

calculate an estimated value of a discharge value for each of unit periods in a standard period of time, the estimating value of the discharge value being a sum of a cancel amount of the power purchase loss in case where the estimated energy demand is covered with discharge of the energy storage apparatus and a power purchase profit based on the estimated generation amount;

calculate an estimated value of a discharge value rate, which is a value obtained by dividing the estimated value of the discharge value by the discharge amount of the energy storage apparatus, for each of the unit periods; and prepare a discharge strategy to distribute the discharge amount of the energy storage apparatus to the respective unit periods, in descending order of estimated values of the discharge value rate;

specify a unit period at which a total of the estimated values of the energy demand becomes equal to or larger than the total discharge amount of the energy storage apparatus, the total being obtained by successively adding the estimated values of the energy demand from a unit period with a highest estimated value of the discharge value rate; and determine an estimated value of the discharge value rate in the specified unit period as a threshold, and the controller is further configured to:

calculate an actual value of the discharge value rate, which is obtained by dividing the discharge amount into a sum of a cancel amount of the power purchase loss in case where the actual value of the energy demand is covered with discharge of the energy storage apparatus and a power selling profit based on the actual value of the generation amount; and discharge the energy storage apparatus when the actual value of the discharge value rate is equal to or larger than the threshold.

* * * * *